US007824192B2

(12) United States Patent
Lin et al.

(10) Patent No.: US 7,824,192 B2
(45) Date of Patent: Nov. 2, 2010

(54) ELECTRICAL CONNECTOR HAVING TWO ENGAGING PORTIONS

(75) Inventors: Min-Han Lin, Tu-Cheng (TW); Kuo-Chun Hsu, Tu-Cheng (TW); Chien-Jen Ting, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/754,539

(22) Filed: Apr. 5, 2010

(65) Prior Publication Data

US 2010/0255710 A1 Oct. 7, 2010

(30) Foreign Application Priority Data

Apr. 3, 2009 (TW) ..... 98111235 A

(51) Int. Cl.
*H01R 12/00* (2006.01)

(52) U.S. Cl. ..... 439/79; 439/607.4

(58) Field of Classification Search ..... 439/79, 439/601.4, 374, 540.1, 660, 680
See application file for complete search history.

(56) References Cited

U.S. PATENT DOCUMENTS

| | | | | |
|---|---|---|---|---|
| 6,764,339 | B2 | 7/2004 | Kubo | |
| 6,971,915 | B1 * | 12/2005 | Mao et al. | 439/607.37 |
| 7,364,464 | B2 * | 4/2008 | Iino et al. | 439/607.55 |
| 7,549,896 | B2 * | 6/2009 | Zhang et al. | 439/607.01 |

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

An electrical connector (100) includes an insulative housing (10) with a base portion (11, 12), a first engaging portion (14) and a second engaging portion (121) extending from the base portion along same direction, a plurality of conductive terminals (30) retained in the insulative housing (10) and a shielding member (20) assembled on the housing. The shielding member (20) has a pair of sidewalls (21, 23) opposite to each other and a pair of end walls (22) surrounding the first engaging portion (14) thereby forming a mating cavity between thereof. One of the end walls (22) is served as a partition located between the first engaging portion (14) and the second engaging portion (121) which extends outwards through the shielding member (20) then nearly presses against the shielding member.

6 Claims, 7 Drawing Sheets

ELECTRICAL CONNECTOR HAVING TWO ENGAGING PORTIONS

BACKGROUND OF THE INVENTION

1. Field of the Invention

The present invention relates to an electrical connector with two engaging portions corresponding to different interface which could transmit different signal.

2. Description of the Related Art

U.S. Pat. No. 6,764,339 issued to Takafumi Kubo on Jul. 20, 2004, discloses an electrical connector including an insulative housing, a plurality of contacts received in the insulative housing and a metallic shell shielding the insulative housing. The insulative housing has a first tongue mating portion and a second mating column near to the first tongue mating portion. The contact includes a first contact arranged on a lower surface of the first tongue mating portion and a second contact received in second mating column for separately transmitting two kinds different signal.

The first tongue mating portion and the second mating column are both located in the metallic shell and without a special member or portion for preventing the cross talk therebetween. Further more, the first tongue mating portion and the second mating column surely work together when the electrical connector is mated to a corresponding mating connector. So it can't use the first tongue mating portion or the second mating column singly as the limit of the structure if the user need.

Therefore, an improved electrical connector is desired to overcome the disadvantages of the related arts.

SUMMARY OF THE INVENTION

An object of the present invention is to provide an electrical connector having two engaging portions, one of which is shielded by a shielding member for preventing thereof from EMI.

In order to achieve above-mentioned object, an electrical connector in accordance with a preferred embodiment of the present invention includes an insulative housing with a base portion, a first engaging portion and a second engaging portion extending from the base portion along same direction, a plurality of conductive terminals retained in the insulative housing and a shielding member assembled on the housing. The shielding member has a pair of sidewalls opposite to each other and a pair of end walls surrounding the first engaging portion, thereby forming a mating cavity between thereof. One of the end walls is served as a partition located between the first engaging portion and the second engaging portion which extends outwards through the shielding member then nearly presses against the shielding member.

Other objects, advantages and novel features of the invention will become more apparent from the following detailed description of the present embodiment when taken in conjunction with the accompanying drawings.

DETAILED DESCRIPTION OF THE INVENTION

Figure 1:
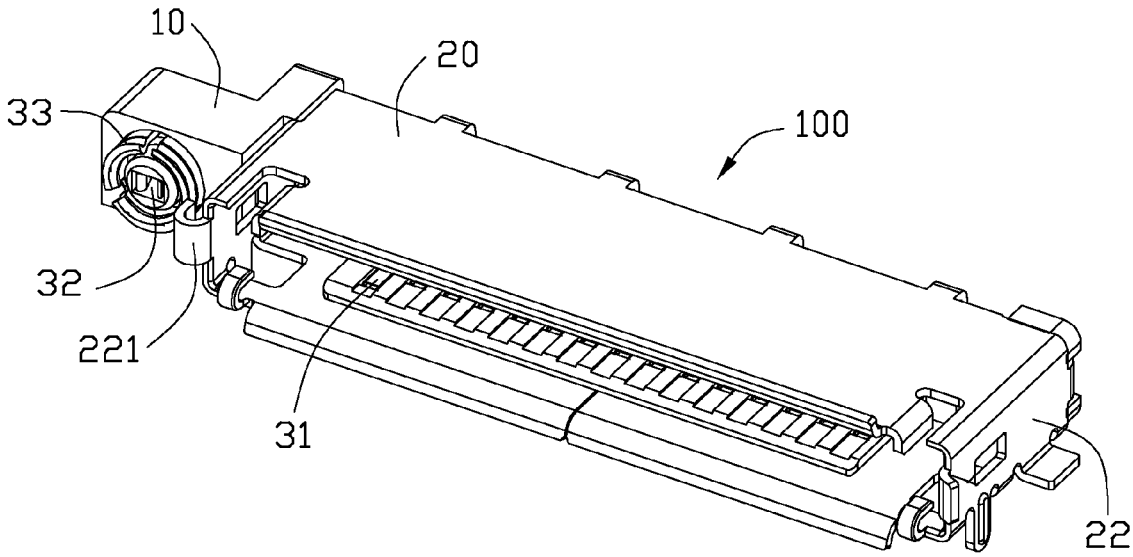
FIG. 1 is a perspective view of an electrical connector in accordance with the preferred embodiment of the present invention.

Reference will now be made to the drawing figures to describe the preferred embodiment of the present invention in detail.

Figure 2:
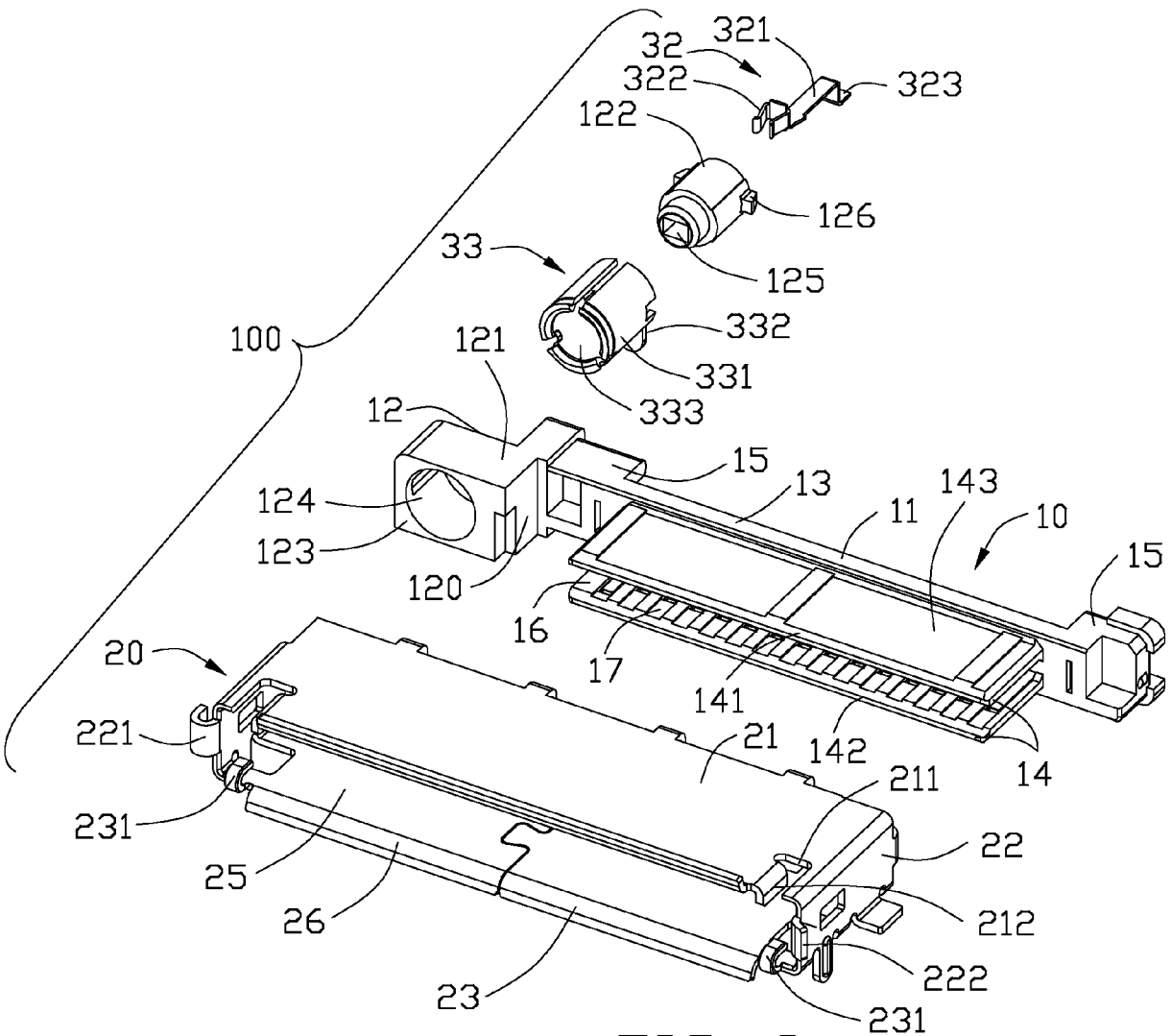
FIG. 2 is an exploded perspective view of the electrical connector of FIG. 1.

Referring to FIGS. 1 and 2, an electrical connector 100 in accordance with the present invention includes two different mating interfaces for alternatively connecting with a mating connector 200 (see FIG. 6) having two different interfaces to transmit two kinds of signal at same time or another mating connector 200' with one interface. The electrical connector 100 includes an insulative housing 10, a shielding member 20 assembled and covering on the housing 10 and a plurality of conductive terminals retained in the insulative housing 10. In this embodiment, the two different mating interfaces are a docking connector interface and a RF connector interface.

Figure 4:
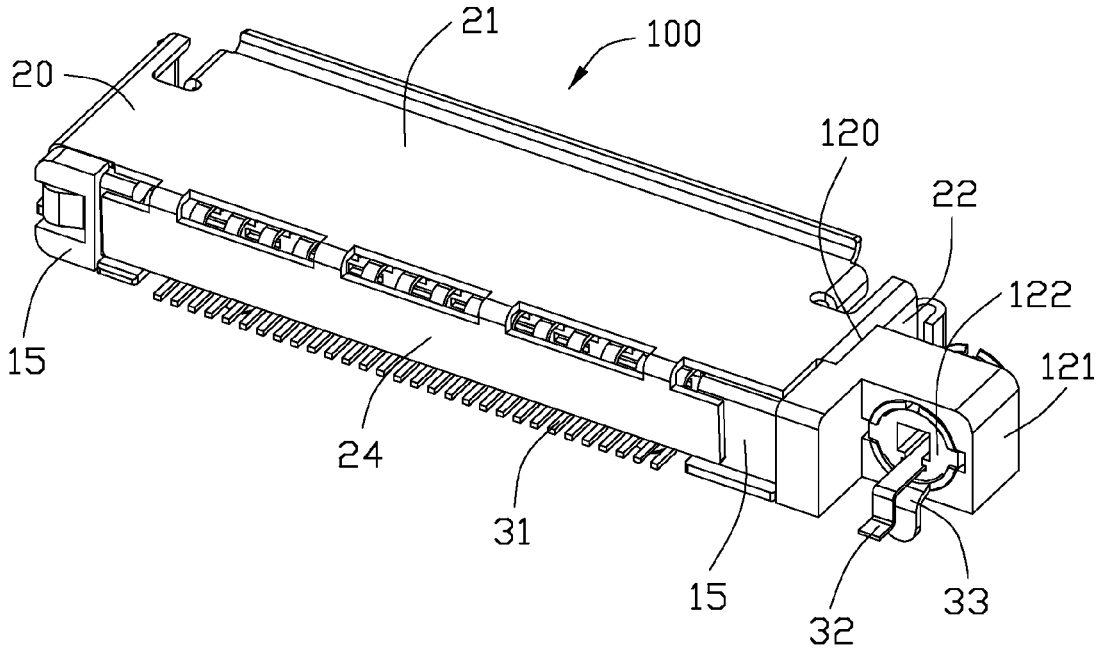
FIG. 4 is another perspective view of the electrical connector of FIG. 1 viewed from a rear view.

Referring to FIGS. 2 and 4, the insulative housing 10 includes a longitudinal first base portion 11 with a front side and a rear side and a second base portion 12 extending along the longitudinal direction. The base portion 12 is extended from one end of the first base portion 11 thereby forming a unitary base portion. The first base portion 11 includes a beam portion 13 and two mounting portion 15. The second base portion 12 unitarily connects with one of mounting portion 15 closed to second the base portion 12 for improving strength of the insulative housing 10. The insulative housing 10 defines a first engaging portion 14 or tongue portion 14, a second engaging portion 121 protruded from the front side of the base portion 11, 12 both along same direction and an insulative spacer 122 retained in the second engaging portion 121. Furthermore, the second engaging portion 121 extends outwards through the shielding member 20 then nearly presses against the shielding member 20 for protecting the shielding member 20 from distortion and reducing the longitudinal size of the electrical connector 100.

Figure 3:
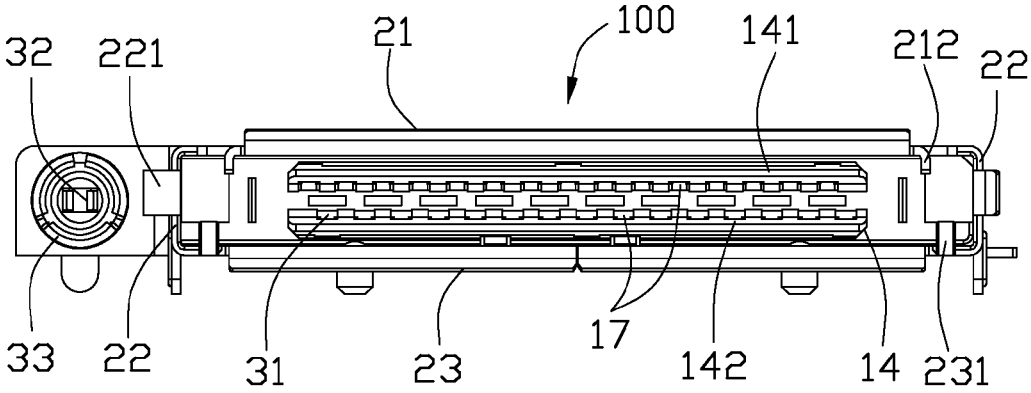
FIG. 3 is a front elevation view of the electrical connector of FIG. 1.
Figure 6:
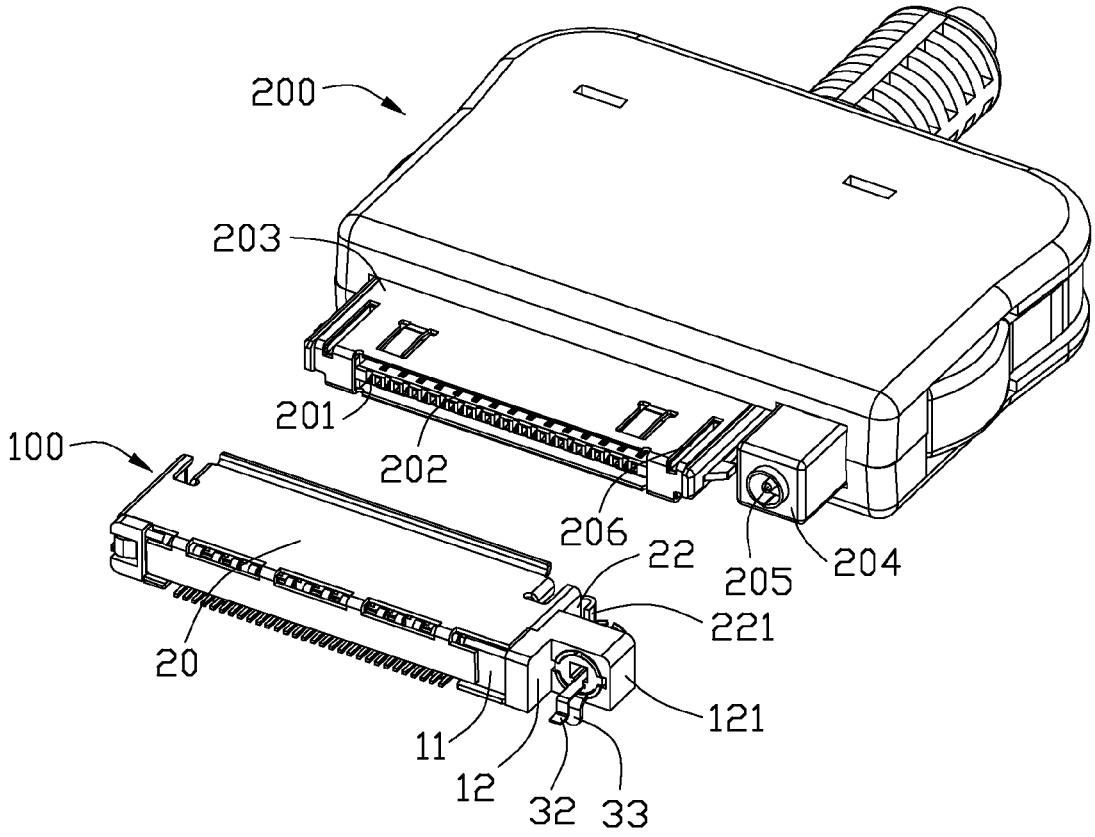
FIG. 6 is a perspective view of the electrical connector of FIG. 1 and a mating connector with two engaging portions not engaging with the electrical connector.

Referring to FIGS. 2 and 3, the first engaging portion 14 has an upper tongue portion 141 and a lower tongue portion 142 which is in parallel to the upper tongue portion 141 thereby forming a mating cavity 16 for mating with a third engaging portion 201 of the mating connector 200 (see FIG. 6). For description purpose, an upper surface 143 of the upper tongue portion 141 is referred to as an upper surface, while a lower surface of the lower tongue portion 142 is referred to as an external surface, while a lower surface of the upper tongue portion 141 and a upper surface of the lower tongue portion 142 are both referred to as internal surface. The inner surfaces of two tongue portions 141, 142 are arranged in face-to-face manner, while the upper surface 143 of the upper tongue portion 141 and the lower surface of the lower tongue portion 142 are arranged in back-to-back manner. The inner surfaces of both the tongue portions 141, 142 are defined with a plurality of first grooves 17 arranged offset and alternatively thereby forming a contacting area between the upper tongue portion 141 and the lower tongue portion 142. The conductive terminal includes a first terminal 31 received in the first base portion 11 and extending towards in the first grooves 17 and being arranged in two rows for transmitting one kind signal.

Figure 5:
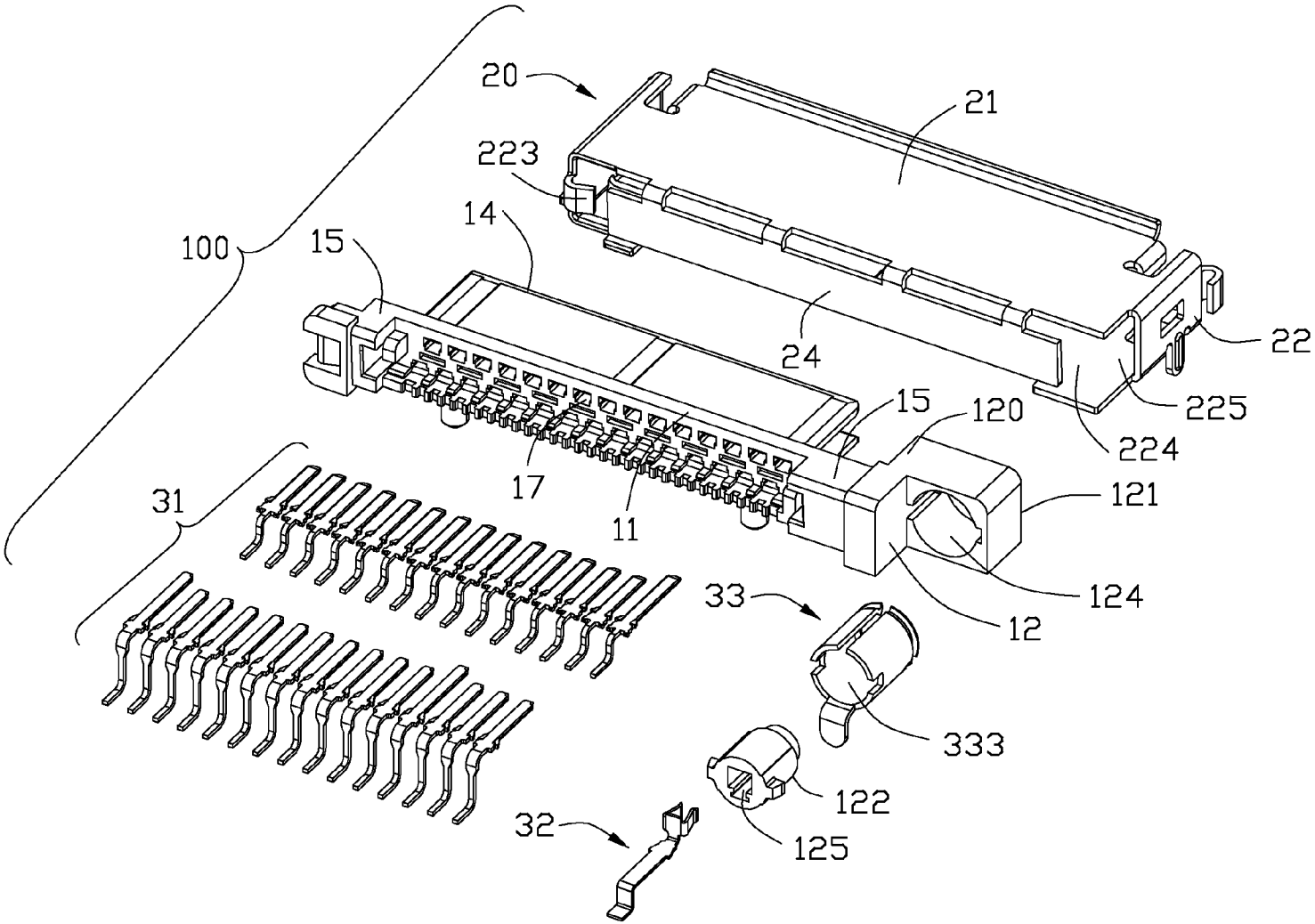
FIG. 5 is an exploded perspective view of the electrical connector of FIG. 4.

Referring to FIGS. 2, 4 and 5, The second engaging portion 121 has a mating surface 123 and a round mating hole 124 extending backwards through the second base portion for being detachably assembled with the insulative spacer 122. The insulative spacer 122 has a round shape with a pair of blocking tuber 126 protruding towards and a second receiving slot 125 extending through thereof along a front-to-rear direction. The conductive terminal includes a second terminal 32 and a hollow grounding terminal 33 both received in the second base portion 12 and different from the first terminal 31 for transmitting another kind of decided signal. The second terminal 32 is inserted into the second receiving slot 125 of the insulative spacer 122 and has a horizontal beam 321 along a rear-to-front direction, a pair of contacting arms 322 extending forwards from front edge of the horizontal beam 321 and a soldering portion 323 extending outwards from rear edge of the horizontal beam 321. The two contacting arms 322 form a slot for correspondingly clipping a forth contact 205 of the mating connector 200 and electrical connecting with each other.

The grounding terminal 33 is a cylindrical configuration and includes a hollow body portion 331 pressing against inside of the mating hole 124 and having a receiving slot 333 for receiving the insulative spacer 122 therein, a soldering tail 332 extending downwards from rear edge of the body portion 331. The blocking tubers 126 are retained in the rear edge of the grounding terminal 33. The grounding terminal 33 is located even sandwiched between the insulative spacer 122 and the second engaging portion 121 after the grounding terminal 33 is assembled outside of the insulative spacer 122 along a rear-to-front direction for preventing the second terminal from EMI and interference with the grounding terminal.

The shielding member 20 surrounds the first engaging portion 14 thereby forming a receiving space 25 with an mating opening 26 with an essential cube frame. The shielding member 20 includes a horizontal upper sidewall 21, a pair of end walls 22 extending and folded downwards from side edges of the upper sidewall 21 at the longitudinal direction, a lower sidewall 23 parallel to the upper sidewall 21 and connecting between the end walls 22 and a rear sidewall 24 extending and folded downwards from a rear edge of the upper sidewall 21. The end walls 22 defines a cutout 224 in a rear edge portion 225 to allow the second base 12 to extend toward and connect with the second mating portion 121 in said longitudinal direction. The insulative housing 10 defines a step structure 120 confronting the end wall 22 of the shielding member 20 in said longitudinal direction around the cutout 224.

The upper sidewall 21 has at least one guiding tab 212 split from a front edge thereof thereby forming a front opening 211. The guiding tab 212 adjoins to the end wall 22 and extending into a corner of the receiving space 25 along a vertical direction essentially perpendicular to the upper sidewall 21 for guiding the mating connector 200 inserted into from the mating opening 26 correctly. The lower sidewall 23 includes at least one guiding arm 231 corresponding and perpendicular to the guiding tab 212 of the upper sidewall 21 and extending inwards the receiving space 25 for further guiding the mating connector 200 mated with the electrical connector 100. One of the end walls 22 is located between the first engaging portion 14 and a second engaging portion 121 for being served as a partition. The end wall 22 forms bended tabs 221, 222 extending backward from a front edge of the end wall 22 and perpendicular to the upper sidewall 22 and the lower sidewall 23. The bended tab 221 serves as part of the partition because it closed to the second engaging portion 121 and used for guiding the mating connector 200 mated with the second engaging portion 121.

Figure 7:
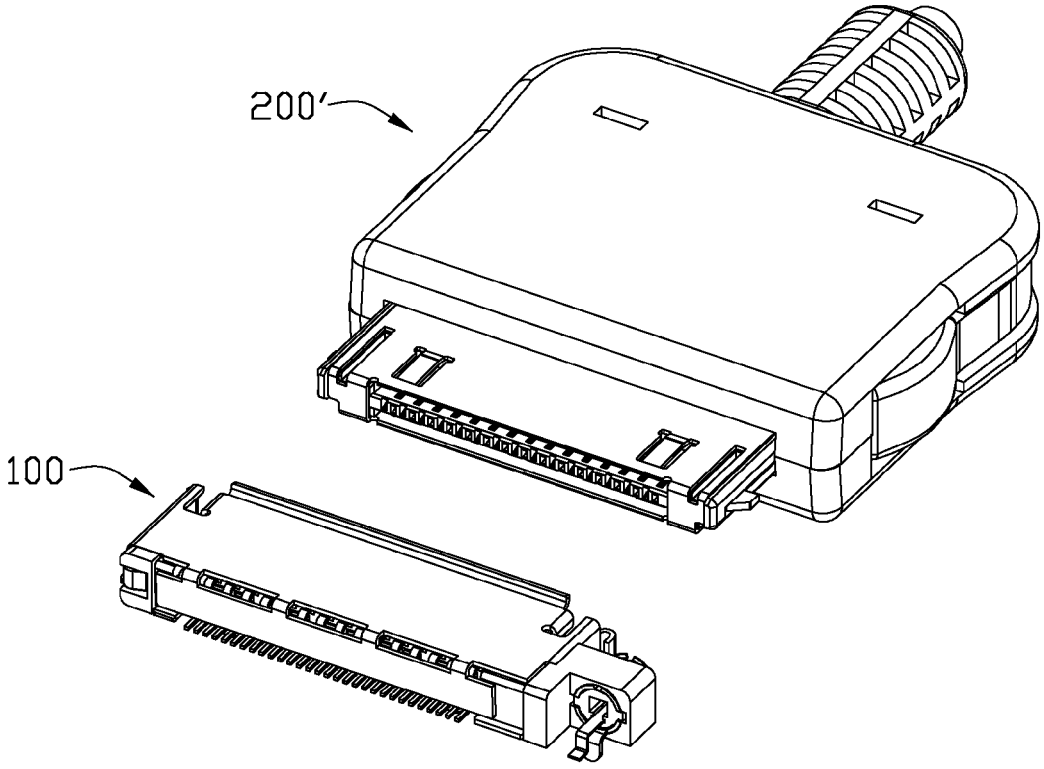
FIG. 7 is a perspective view of the electrical connector of FIG. 1 and another mating connector with one engaging portion not engaging with the electrical connector.

Referring to FIGS. 2, 6 and 7, the mating connector 200 is defined with the third engaging portion 201, a plurality of third contact 202 retained in the third engaging portion, a shell 203 covering on the third engaging portion 201, a forth engaging portion 204 and the forth contact 205 received in the forth engaging portion. The third engaging portion 201 is mated with the first engaging portion 14 and the forth engaging portion 204 is mated with the second engaging portion 121 for transmitting corresponded signals. The forth contact 205 is received between the two contacting arms 322 of the electrical 100 and electrical connecting with each other. The shell 203 defines a pair of slot 206 in which the guiding tabs 212 of the electrical 100 slide the front-to-rear direction for guiding purpose.

The second engaging portion 121 is located outside of the shielding member 20 and preventing the second terminal 31 and the first terminal 32 from cross-talking. Added the size of the shielding member 20 is changed by the first engaging portion 14 and doesn't relate to the second engaging portion 121. When the user just only need to use one interface, it could make the single mating connector 200' without the second engaging portion 121 to mate with the electrical connector 100. So the electrical connector 100 could be mated with a mating connector 200 or another mating connector 200' alternatively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising: an insulative housing comprising a base portion, a first engaging portion and a second engaging portion extending from the base portion along same direction; a plurality of conductive terminals retained in the insulative housing; a shielding member assembled on the housing, comprising a pair of sidewalls opposite to each other and a pair of end walls surrounding the first engaging portion, thereby forming a receiving space therebetween; wherein one of the end walls is served as a partition located between the first engaging portion and the second engaging portion which extends outwards through the shielding member then nearly presses against the shielding member, wherein the end wall forms a bended tab extending backward from a front side of the end wall and serve as part of the partition, wherein the pair of sidewalls comprise an upper sidewall and a lower sidewall perpendicular to the bended tab, wherein the second engaging portion forms a mating hole for being detachably assembled with a round shape spacer defined by the insulative housing, wherein the conductive terminal comprises a second terminal received in the round shape spacer and a grounding terminal sandwiched between the spacer and the mating hole which is assembled along a rear-to-front direction, wherein the grounding terminal is a cylindrical configuration and comprises a hollow body portion pressing against inside of the mating hole thereby forming a receiving slot for accepting the round shape spacer, a soldering tail extending downwards from rear edge of the body portion, wherein the terminal comprise a first terminal different from the second terminal which are used for transmitting two kinds signal.

2. The electrical connector as described in claim 1, wherein the second engaging portion unitarily connect with the first engaging portion.

3. The electrical connector as described in claim 2, wherein at least one guiding tab is split from a front edge of the upper sidewall adjoining to the end wall and extending into the receiving space along a vertical direction essentially perpendicular to the upper sidewall.

4. The electrical connector as described in claim 3, wherein the lower sidewall comprises at least one guiding arm corresponding and perpendicular to the guiding tab of the upper sidewall and extending inwards the receiving space.

5. The electrical connector as described in claim 3, wherein the first engaging portion comprises a pair of tongue portions extending forwards from base portion in the receiving space and defining a plurality of first grooves for receiving the conductive terminals therein.

6. An electrical connector comprising: an insulative housing defining a commonly base extending along a longitudinal direction thereof; first and second mating portions respectively forwardly extending from the base and spaced from each other with a distance in the longitudinal direction; a plurality of first contacts disposed in the housing with first contacting sections exposed in the first mating portion; a plurality of second contacts disposed in the housing with second contacting sections exposed in the second mating portion; and a metallic frame assembled to the housing in a front-to-back direction perpendicular to said longitudinal direction and only shielding circumferentially the first mating portion for mating with a first complementary connector; wherein said frame defines a cutout in a rear edge portion to allow the base to extend toward the second mating portion in said longitudinal direction, wherein said metallic frame defines not only a front opening for guiding and mating the first complementary connector but also a wedged structure for guiding a second complementary connector which is adapted to be mated with the second mating portion, wherein the housing defines a step structure confronting the frame in said longitudinal direction around the cutout.

* * * * *